US006120271A

United States Patent [19]

Mallen

[11] Patent Number: 6,120,271

[45] Date of Patent: Sep. 19, 2000

[54] VANE SLOT ROLLER ASSEMBLY FOR ROTARY VANE PUMPING MACHINE AND METHOD FOR INSTALLING SAME

[75] Inventor: Brian D. Mallen, Charlottesville, Va.

[73] Assignee: Mallen Research Corporation, Charlottesville, Va.

[21] Appl. No.: 09/185,707

[22] Filed: Nov. 4, 1998

[51] Int. Cl.[7] ..... F01C 21/00

[52] U.S. Cl. ..... 418/235; 418/173; 418/265; 29/888.025; 123/8.45

[58] Field of Search ..... 418/235, 173, 418/265; 29/888.025; 123/8.45

[56] References Cited

U.S. PATENT DOCUMENTS

| | | | |
|---|---|---|---|
| 2,048,825 | 7/1936 | Smelser | 418/235 |
| 2,071,799 | 2/1937 | Mabille | 418/235 |
| 2,562,698 | 7/1951 | Clerc | 418/235 |
| 3,812,828 | 5/1974 | Griffiths | 123/8.45 |
| 4,451,219 | 5/1984 | Kurherr . | |

FOREIGN PATENT DOCUMENTS

| | | | |
|---|---|---|---|
| 2481373 | 1/1990 | France | 418/235 |
| 3822935 | 1/1990 | Germany | 418/235 |

*Primary Examiner*—Thomas Denion
*Assistant Examiner*—Thai-Ba Trieu
*Attorney, Agent, or Firm*—Jones Volentine, L.L.P.

[57] ABSTRACT

A vane slot assembly and installation method for a rotary vane pumping machine including a rotor with a rotor axis of rotation. The rotor has a vane slot with two opposing, azimuthally separated, slot side walls. The rotor has a primary slot gear rack disposed radially along a first slot side wall. A radially reciprocating vane is movably disposed between the slot side walls. The vane has side walls facing the slot side walls, and has a primary vane gear rack disposed radially along a first vane side wall facing the first slot side wall. A plurality of vane slot rollers are movably disposed between the first slot side wall and the first vane side wall. The rollers have axes of rotation substantially parallel to the rotor axis and include an aligned roller having a primary roller gear. The primary roller gear engages the primary vane gear rack and the primary slot gear rack. As a result, friction-reducing roller bearings between the vane and the rotor slot are properly aligned radially.

18 Claims, 8 Drawing Sheets

VANE SLOT ROLLER ASSEMBLY FOR ROTARY VANE PUMPING MACHINE AND METHOD FOR INSTALLING SAME

BACKGROUND OF THE INVENTION

1. Field of the Invention

The present invention generally relates to rotary vane pumping machines, and more particularly, to a vane slot roller assembly that provides a friction-reducing, momentum-transferring interface between the vanes and slot walls in a rotor of a rotary vane pumping machine, and an installation method for the assembly.

2. Description of the Related Art

The overall invention relates to a large class of devices comprising all rotary vane (or sliding vane) pumps, compressors, engines, vacuum-pumps, blowers, and internal combustion engines. Herein the term pumping machine refers to a member of a set of devices including pumps, compressors, engines, vacuum-pumps, blowers, and internal combustion engines. Thus, this invention relates to a class of rotary vane pumping machines.

This class of rotary vane pumping machines includes designs having a rotor with slots with a radial component of alignment with respect to the rotor's axis of rotation, vanes which reciprocate within these slots, and a chamber contour within which the vane tips trace their path as they rotate and reciprocate within their rotor slots.

The reciprocating vanes thus extend and retract synchronously with the relative rotation of the rotor and the shape of the chamber surface in such a way as to create cascading cells of compression and/or expansion, thereby providing the essential components of a pumping machine.

Some means of radially guiding the vanes is provided to ensure near-contact, or close proximity, between the vane tips and chamber surface as the rotor and vanes rotate with respect to the chamber surface.

Several conventional radial guidance designs were described in the background section of pending U.S. patent application Ser. No. 08/887,304, to Mallen, filed Jul. 2, 1997, entitled "Rotary-Linear Vane Guidance in a Rotary Vane Pumping Machine" ('304 application). The '304 application describes an improved vane guidance means in order to overcome a common shortcoming of the conventional means of guiding the vanes, namely that high linear speeds are encountered at the radial-guidance frictional interface. These high speeds severely limit the maximum speed of operation and thus the maximum flow per given engine size.

In the improved sliding-vane pumping geometry of the '304 application, multiple vanes sweep in relative motion against the chamber surfaces, which incorporates a radial-guidance frictional interface operating at a reduced speed compared with the tangential speed of the vanes at the radial location of the interface. This linear translation ring interface permits higher loads at high rotor rotational speeds to be sustained by the bearing surfaces than with conventional designs. Accordingly, much higher flow rates are achieved within a given size pumping device or internal combustion engine, thereby improving the performance and usefulness of these machines.

However, even with the above advantages, efforts continue in order to further refine and enhance the performance of the rotary machine. In particular, rollers of a rolling frictional interface between the reciprocating vanes and the walls of the slots must be properly distributed along the wall between the vane and its slot to simultaneously reduce friction and transfer momentum between the rotor and the vanes. However, because these vane slot rollers are disposed in a slot that is part of a rotating rotor, a centripetal acceleration force may subject the rollers to severe misalignment in the radial direction. That is, the vane slot rollers have a tendency to congregate at the outward portion of the rotor slots, where the rollers do not provide adequate friction reduction and momentum transfer for the portions of the vane closer to the rotor axis, especially when the vane is retracted into the slot. In addition, the shift of rollers to the outward portion of the rotor slots is accompanied by roller slippage which causes excessive wear on the rollers themselves, shortening their useful life.

Furthermore, simple cylindrical rollers do not provide axial control for the vanes. As a result, the vanes may drift from one axial side of the rotor to another, leading to increased friction and wear with the axial sides of the chamber and variable performance during the operation of the rotary vane pumping machine.

Therefore, there is a need for vane slot rollers which are properly aligned with the vane and slot walls, which do not slip, and which provide enhanced control of the axial position of the vane.

SUMMARY OF THE INVENTION

Accordingly, the present invention is directed to a rotary vane pumping machine that substantially overcomes one or more of the problems due to the limitations and disadvantages of the related art.

It is an object of the present invention to provide means for maintaining the positional alignment of vane slot rollers between the vane and the slot wall to enhance the overall friction and wear reducing effect and momentum transfer of the vane slot rollers.

It is another object of the present invention to provide means for centering the vane in the slot to avoid friction and wear with the axial sides of the chamber and stabilize the performance of the rotary vane pumping machine.

In the present invention, an engine geometry is employed utilizing reciprocating vanes which extend and retract synchronously with the relative rotation of the rotor and the shape of the chamber surface in such a way as to create cascading cells of compression and/or expansion, thereby providing the essential components of a pumping machine.

More specifically, the present invention provides a vane slot roller assembly that maintains cylindrical roller bearings at the proper radial positions, in the space between the rotor and the vane, using gears and gear racks while keeping the load bearing function on the rollers rather than on the gears. The present invention also can be used to constrain axial movement of the vane to thereby reduce friction and wear with axial sides of the chamber.

To achieve these and other advantages and in accordance with the purpose of the invention, a vane slot roller assembly for a rotary vane pumping machine includes a rotor with a rotor axis of rotation. The rotor has a vane slot with two opposing, azimuthally separated, slot side walls. The rotor has a primary slot gear rack disposed radially along a first slot side wall. A radially reciprocating vane is movably disposed between the slot side walls. The vane has opposing side walls confronting the respective slot side walls, and has a primary vane gear rack disposed radially along a first vane side wall confronting the first slot side wall. A plurality of vane slot rollers are movably disposed between the first slot side wall and the first vane side wall. The rollers have axes of rotation substantially parallel to the rotor axis and include an aligned roller having a primary roller gear. The primary roller gear engages the primary vane gear rack and the primary slot gear rack. As a result, friction-reducing, momentum-transferring roller bearings between the vane and the rotor slot are properly aligned radially.

In another aspect of the invention, a slot groove is disposed along the first slot side wall and a vane groove is disposed along the first vane side wall confronting the first slot side wall. A plurality of vane slot rollers includes an axial centering roller having an extension sleeve, wherein the extension sleeve engages the vane groove and the slot groove. As a result, the vane is constrained from moving axially and, consequently, friction and wear with the axial faces of the chamber is reduced.

In another aspect of the invention, a vane slot assembly for a rotary vane pumping machine includes a rotor with a rotor axis of rotation, having a vane slot with two opposing azimuthally separated slot side walls. A primary slot gear rack plate is fixed to a first axial face of the rotor so that a primary slot gear rack formed on the plate is disposed radially along a first slot side wall. A slot rack fixing means fixes the primary slot gear rack plate to the first axial face of the rotor. A radially reciprocating vane is movably disposed between the slot side walls. The vane has vane side walls confronting the slot side walls and has a primary vane gear rack disposed radially along a first vane side wall confronting the first slot side wall. A plurality of vane slot rollers are movably disposed between the first slot side wall and the first vane side wall. The slot rollers have axes of rotation substantially parallel to the rotor axis. The slot rollers include an aligned roller having a primary roller gear which engages both the primary vane gear rack and the primary slot gear rack.

In another aspect of the invention, a method of installing a vane slot assembly for a rotary vane pumping machine having a rotor with vane slots and vanes, includes positioning a vane having a vane gear rack in a vane slot of a rotor. An aligned roller is engaged with the vane gear rack. A slot gear rack plate is positioned against an axial face of the rotor so a slot gear rack is disposed radially along a slot side wall and engages the aligned roller. The slot gear rack plate is fixed to the axial face of the rotor.

In another aspect of the invention, a method of installing a vane slot assembly for a rotary vane pumping machine having a rotor with vane slots and vanes includes positioning an aligned roller in an axial filler slot in a vane slot of a rotor. The vane slot has a slot gear rack on a slot side wall contiguous with the axial filler slot. A vane with a vane gear rack on a vane side wall is inserted into the vane slot until an entry point on the vane gear rack is facing the axial filler slot. The aligned roller is engaged with the vane gear rack, and the vane is inserted further into the slot. Thus, the aligned roller rolls to a radially inward location engaged with both the vane gear rack and the slot gear rack.

BRIEF DESCRIPTION OF THE DRAWINGS

The foregoing and other objects, aspects, and advantages will be described with reference to the drawings, certain dimensions of which have been exaggerated and distorted to better illustrate the features of the invention, and wherein like reference numerals designate like and corresponding parts of the various drawings, and in which.

DETAILED DESCRIPTION OF THE INVENTION

Reference will now be made in detail to an embodiment of a rotary pumping machine incorporating a means for rotary-vane guidance and a rotor vane interface, examples of which are illustrated in the accompanying drawings. The embodiments described below may be incorporated in all rotary-vane or sliding vane pumping machines.

U.S. patent application Ser. No. 08/887,304, to Mallen, filed Jul. 2, 1997, entitled "Rotary-Linear Vane Guidance in a Rotary Vane Pumping Machine" ('304 application), is hereby incorporated by reference in its entirety. For ease of discussion, certain portions of the '304 application will be reiterated below where appropriate.

Figure 1:
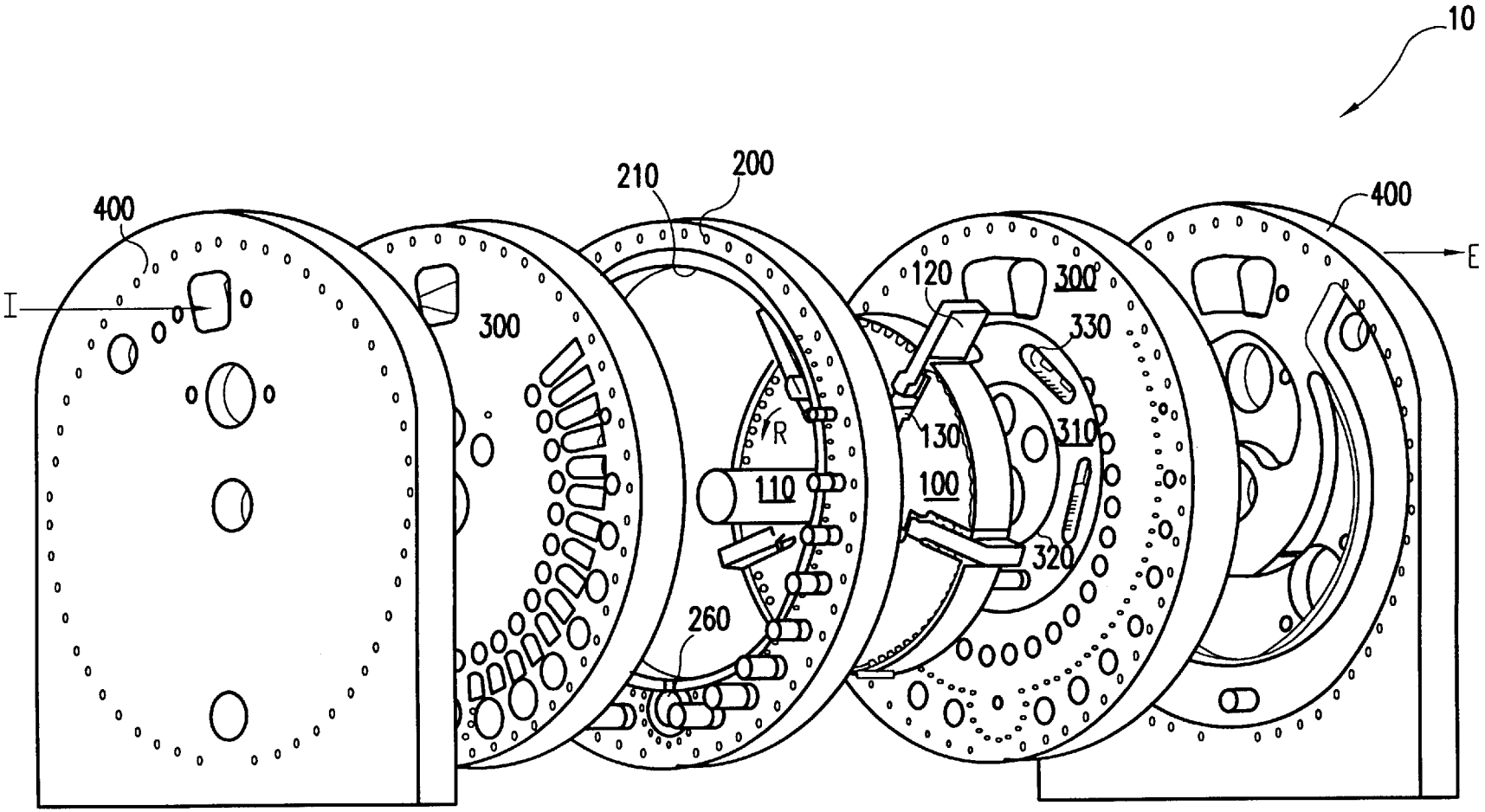
FIG. 1 is an exploded perspective view of a rotary-vane pumping machine in accordance with the present invention.

An exemplary embodiment of the rotary engine assembly incorporating a rotary-linear vane guidance mechanism is shown in FIG. 1 and is designated generally as reference numeral 10.

The engine assembly contains a rotor 100, with the rotor 100 and rotor shaft 110 rotating about a rotor shaft axis in a counterclockwise direction as shown by arrow R in FIG. 1. It can be appreciated that when implemented, the engine assembly could be adapted to allow the rotor 100 to rotate in a clockwise direction if desired. The rotor 100 has a rotational axis, at the axis of the rotor shaft 110, that is fixed relative to a stator cavity 210 contained in the chamber ring assembly 200.

Figure 2:
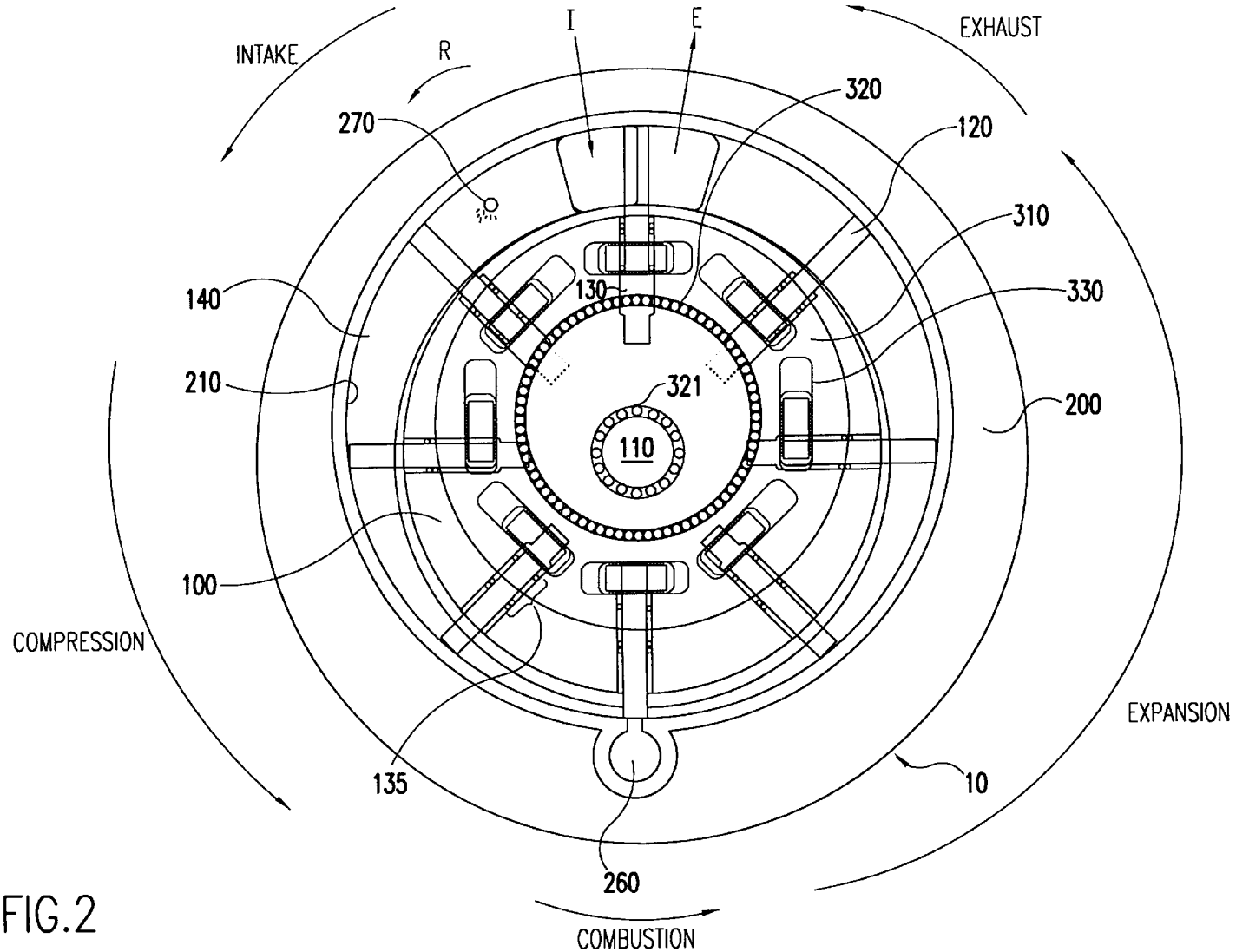
FIG. 2 is a side sectional view of a rotary-vane pumping machine in accordance with the present invention.

The rotor 100 houses a plurality of vanes 120 in vane slots 130, wherein each pair of adjacent vanes 120 defines a vane cell 140 (see FIG. 2). The contoured stator 210 forms the roughly circular shape of the chamber outer surface.

Figure 3:
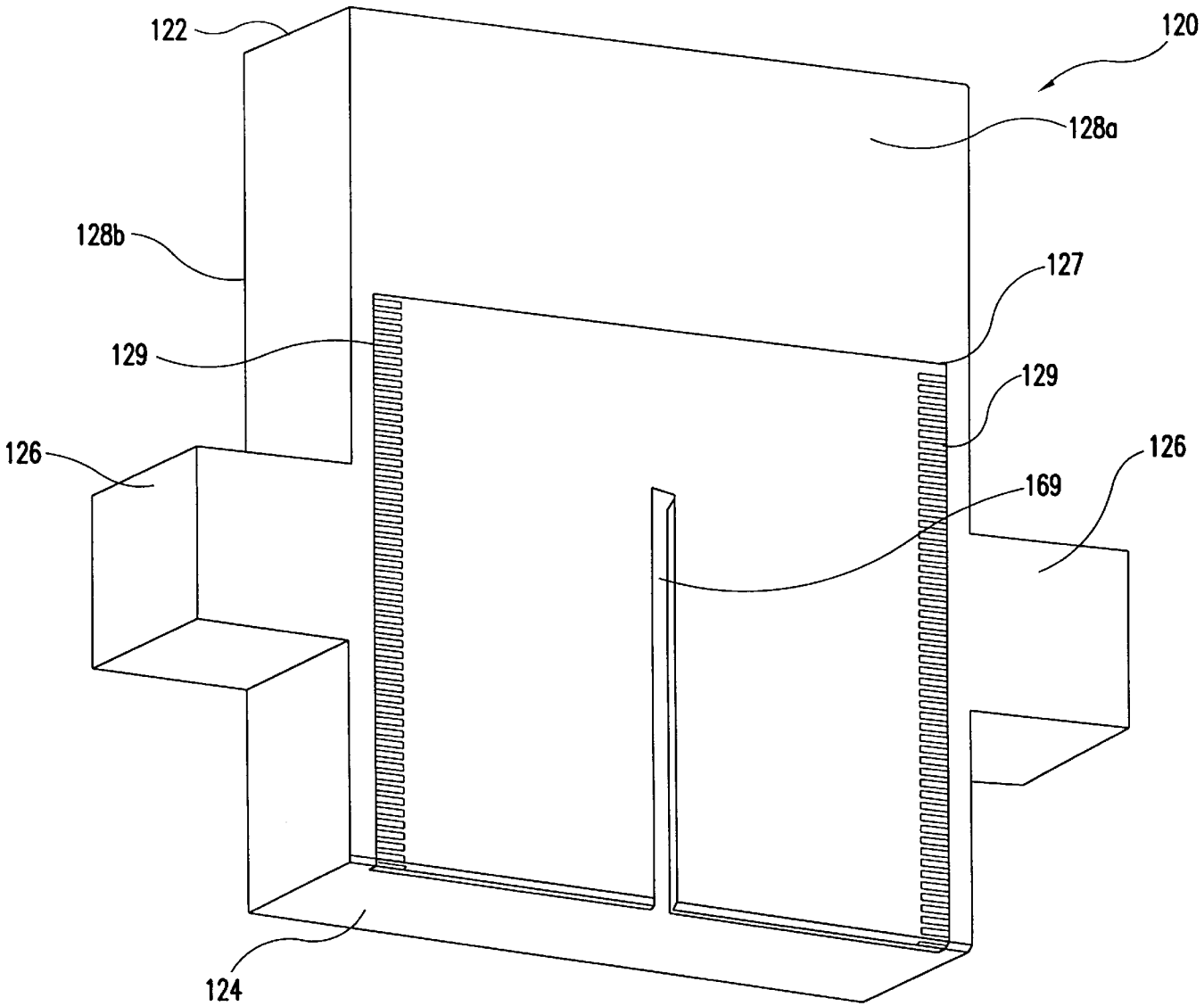
FIG. 3 is a perspective view of one embodiment of the vane employed in the present invention.

Each of the vanes 120 has a tip portion 122 and a base portion 124, with a protruding tab 126 extending from either or both axial ends near the base portion as shown in FIG. 3. While the protruding tab 126 of the vane in FIG. 3 is quadrilateral, the invention is not limited to such a design, it being understood that the tab may take on many shapes within the scope of the invention. The tab need not be symmetrical with respect to the vane nor with the opposing tab, if any. The vane 120 has two side walls 128*a* and 128*b* which lead or follow the azimuthal direction of rotation of the vane when the vane is installed in the rotor 100 and the pumping machine 10 is operated. The side walls 128*a* and 128*b* interface with the slots 130 of the rotor 100.

As shown in FIGS. 1 and 2, a linear translation ring assembly plate 300 is disposed at each axial end of the chamber ring assembly 200. The linear translation ring 310 itself spins freely around a fixed hub 320 located in the linear translation ring assembly plate 300, with the axis 321 of the fixed hub 320 being eccentric to the axis of rotor shaft 110 as best seen in FIG. 2. The linear translation ring 310 may spin around its hub 320 utilizing any type of bearing at the hub-ring interface including for example, ajournal bearing of any suitable type and an anti-friction rolling bearing of any suitable type.

The linear translation ring 310 contains a plurality of linear channels 330. The linear channels 330 allow the vanes 120 to translate linearly as the linear translation ring 310 rotates around the fixed hub 320.

In operation, each of the pair of protruding tabs 126 of each of the plurality of vanes 120 communicates with a respective linear channel 330 in the linear translation ring 310. That is, one protruding tab 126 communicates with a linear channel 330 in the linear translation ring 310 located at one axial end of the engine assembly, and the other protruding tab 126 communicates with a linear channel 330 in the linear translation ring 310 located at the other axial end of the engine assembly.

Though the machine 10 could operate successfully with the tabs 126 on only one side of the vanes 120 and communicating with only one linear translation ring 310, the best performance is obtained by the balanced, two-ended arrangement described above, namely, a linear translation ring 310 located at each axial end of the machine 10 and protruding tabs 126 communicating with each.

In operation, the rotor 100 rotation causes rotation of the vanes 120 and a corresponding rotation of each linear translation ring 310. The protruding vane tabs 126 within the linear channels 330 of the linear translation rings 310 automatically set the linear translation rings 310 in rotation at a fixed angular velocity identical to the angular velocity of the rotor 100. Therefore, the linear translation ring 310 does not undergo any significant angular acceleration at a given rotor rpm.

Also, the rotation of the rotor 100 in conjunction with the linear translation rings 310 automatically sets the radial position of the vanes 120 at any rotor angle, producing a single contoured path as traced by the vane tips 122 resulting in a unique stator cavity 210 shape that mimics and seals the path the vane tips trace.

No gearing is needed to maintain the proper angular position of the linear translation rings 310 because this function is automatically performed by the geometrical combination of the tabs 126 within the linear channels 330 of the linear translation rings 310, the vanes 120 constrained to radial motion within their rotor slots 130, the rotor 100 about its shaft 110 axis, and the translation ring hub 320 about its offset axis 321 at the center of the fixed hub 320.

The linear channels 330 are not exposed to the engine chamber and can thus be lubricated with, for example, oil, oil mist, dry film, grease, fuel, fuel vapor or mist, or combination thereof, without encountering major lubricant contamination problems.

As shown in FIGS. 1 and 2, a combustion residence chamber 260 may be provided in the chamber ring assembly 200. The combustion residence chamber 260 is a cavity or series of cavities within the chamber ring assembly 200, radially and/or axially disposed from a vane cell 140, which communicates with the air or fuel-air charge at about peak compression in the engine assembly. The combustion residence chamber 260 may create an extended region in communication the vane cell 140 during peak compression.

The particular parameters of such an extended region (e.g., the compression ratio, vane rotor angle, number of vanes, combustion residence chamber position and volume) may vary considerably within the practice of this invention. What is important in an internal combustion engine application is that there can be a sufficient duration to the combustion region so that there is adequate time to permit near-complete combustion of the fuel. The combustion residence chamber, by retaining a hot combusted charge in its volume, permits very lean mixtures to be combusted. This characteristic permits very low pollution levels to be achieved, as more fully described in U.S. Pat. No. 5,524,586, and issued U.S. application Ser. No. 08/774,275, of Mallen et al., filed Dec. 27, 1996, and entitled "Method of Reducing Pollution Emissions in a Two-Stroke Sliding Vane Internal Combustion Engine".

A pair of cooling plates 400 encase the engine 10, provide for cooling channels, and serve as an attachment point for various devices used to operate the engine 10. Of course, the function of the cooling plates 400 may be incorporated in the linear translation ring assemblies 300. In other words, a single plate could provide the features of both the linear translation ring assembly 300 and the cooling plate 400, or separate plates could be utilized. The remaining discussion assumes separate plates are employed.

When the present invention is utilized with internal combustion engines, one or more fuel injecting devices 270 (FIG. 2) may be used and may be placed on one or both axial ends of the chamber and/or on the outer or inner circumference to the chamber. Each injector 270 may be placed at any position and angle chosen to facilitate equal distribution within the cell or vortices while preventing fuel from escaping into the exhaust stream. The injector(s) 270 may alternatively be placed in the intake port air flow as more fully described in U.S. Pat. No. 5,524,586.

The illustrated internal combustion engine embodiment employs a two-stroke cycle to maximize the power-to-weight and power-to-size ratios of the engine. The intake of the fresh air I and the scavenging of the exhaust E occur at the regions as shown in FIG. 1 and FIG. 2. One complete engine cycle occurs for each revolution of the rotor 100.

The present invention is directed to the radial movement of the vanes 120 relative to the slots 130 in the rotor 100 and specifically, to a vane slot roller assembly 135 at the interface between the slots 130 and the vanes 120. Herein, radial movement means any movement incorporating a radial component. The vane's shape and movement may incorporate any offset, diagonal, angular, or arcuate component, provided the radial component of movement is present and provided the geometry works in accordance with the linear translation ring channel geometry.

In a rotary vane engine, momentum is transferred from the expanding gases working on the vanes 120 in the expanding vane cell 140, to the rotor 100 through the load bearing function of the rollers in the assembly 135. In a rotary pump and during the exhaust or pre-combustion compression cycles, momentum is transferred from the rotor to the gases in a compressing vane cell 140 through the load bearing function of the rollers in the assembly 135. In both embodiments, the vanes 120 are radially reciprocating relative to the rotor slots 130, and the friction of sliding between the radially reciprocating vanes and the rotor is reduced by the rolling function of the rollers in the assembly 135.

Figure 4A:
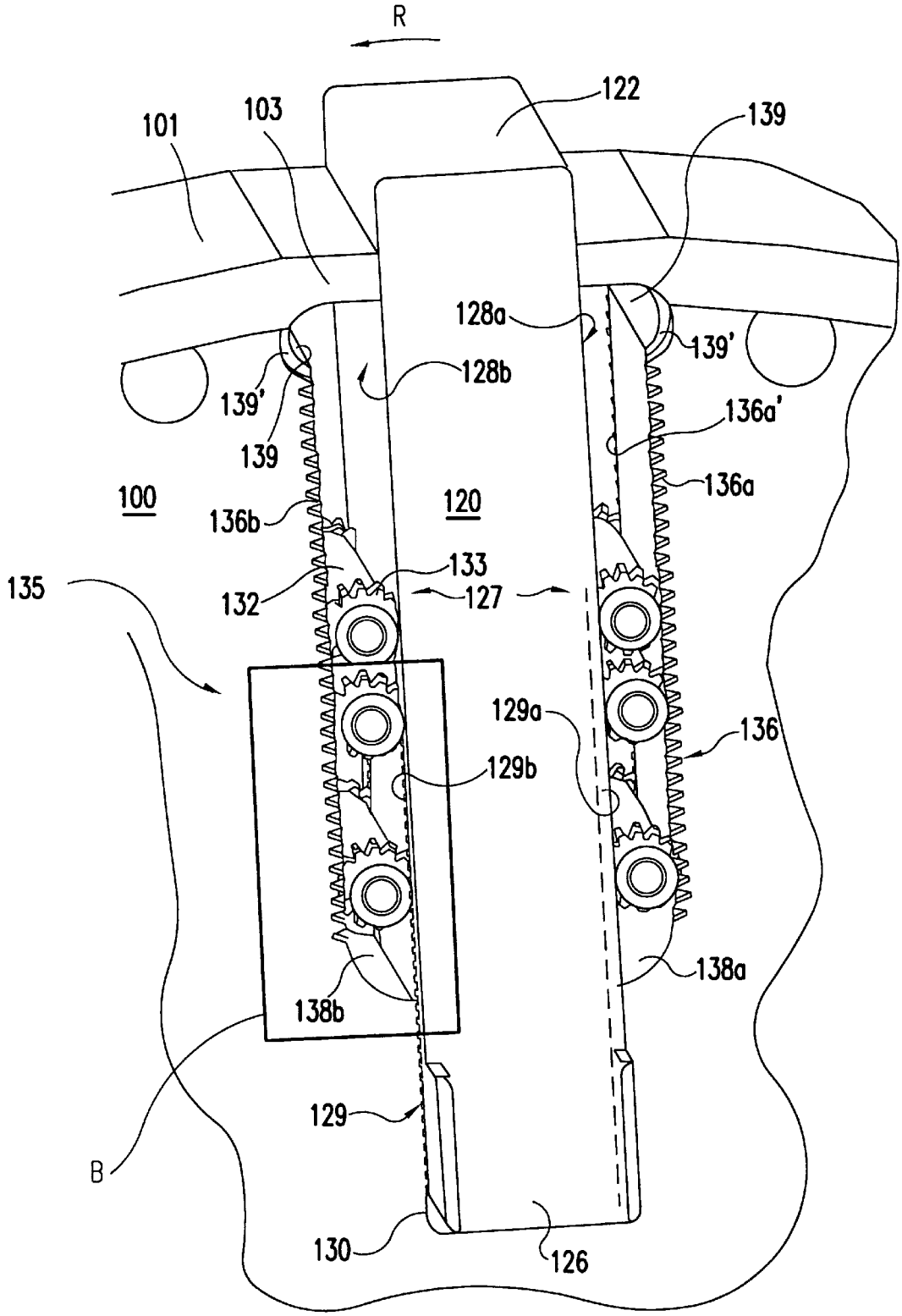
FIG. 4A is a perspective view of the vane slot roller assembly according to one embodiment of the present invention employing aligned rollers.

As shown in FIG. 4A the vane slot roller assembly 135 includes aligned rollers 132 which have roller gears 133. The assembly 135 also includes gear racks 129, 136 on the vane 120 and on the rotor 100, respectively. The rollers 132 with roller gears 133 are called aligned rollers 132 because they are kept properly positioned between the vane 120 and the vane slot 130 throughout the reciprocating motion of the vane 120 even though centrifugal forces would normally act to cause the aligned rollers 132 to slip toward the outer portion of the vane 120, farthest from the axis of rotation of the rotor 100. The outer portion of the vane 120 and rotor 100 are at the top of the drawing as viewed in FIG. 4A. Conventional rollers without roller gears are not shown in the drawings.

The vane slot 130 has two opposing slot side walls 138*a* and 138*b* separated in the azimuthal direction of rotation R of the rotor 100. At least one primary slot gear rack 136, e.g., 136*a*, is disposed radially along at least one of these slot side walls 138, e.g., 138*a*. In the preferred embodiment a second, opposing slot gear rack 136*b* is disposed radially along the opposing slot side wall 138*b*.

The vane 120 itself also has two side walls 128, each confronting a corresponding slot side wall 138, for example, vane side wall 128*b* faces slot side wall 138*b*, and vane side wall 128*a* faces slot side wall 138*a*, as shown in FIG. 4A. At least one primary vane gear rack 129, e.g., 129*a*, is disposed in at least one of the vane side walls 128, e.g., 128*a*, facing a corresponding slot gear rack 136*a* in the corresponding slot side wall 138*a*. In the preferred embodiment a second, opposing vane gear rack 129*b* is disposed in the opposing vane side wall 128*b* and faces the slot side wall 138*b*.

At least one aligned roller 132 with the roller gear 133 is disposed between the vane slot 130 and the vane 120 so that its roller gear 133 engages both a primary slot gear rack 136, e.g., 136*a*, and a primary vane gear rack 129, e.g. 129*a*. In the preferred embodiment at least one other aligned roller 132 is disposed on the opposing side of the vane 120 so that its roller gear 133 engages both the opposing slot gear rack 136*b* and the opposing vane gear rack 129*b*.

Aligned rollers 132 can roll radially only as the vane 120 moves, because the teeth of the roller gear 133 are constrained by the racks 129, 136 on the vane side wall 128 and the slot side wall 138. As the vane 120 extends outward, the aligned rollers 132 roll outward also, relative to the slot wall 138, but at half the speed of the vane 120, and thus the aligned rollers 132 move inward relative to the outward moving vane 120. As the vane 120 retracts, the aligned rollers 132 roll inward, toward the axis of rotation of the rotor 100, also at half the speed of the vane 120, and thus move outward relative to the inward moving vane 120. The aligned rollers 132 may be prevented from rolling independently of the vane movement, and in particular are prevented from slipping outward in response to the centrifugal force. If any non-aligned rollers (not shown) are provided, they can be prevented from slipping in response to the centrifugal force, which is always directed outward while the rotor 100 is rotating, if the outermost roller is an aligned roller 132.

As shown in FIG. 3 and FIG. 4A, the upper ends of the vane gear racks 129 extend to an outer terminal position 127 that is spaced substantially away from the vane tip 122 in the preferred embodiment. The outer terminal position 127 may be chosen such that the upper end of the vane gear rack 129 does not extend outside the outer diameter 101 of the rotor as the vane 120 reciprocates. The outer diameter 101 of the rotor is defined as the diameter of a circle centered on the axis of rotation of the rotor 100 that is substantially tangent to the radial surface of the rotor 100 farthest from its axis of rotation (excluding vanes 120). When the upper end of the vane gear rack 129 does not extend outside the outer diameter 101 of the rotor as the vane 120 reciprocates, it minimizes contaminating constituents of the airborne environment enveloping the rotor 100 axial face from being transported within the recesses of the vane gear rack 129 to positions outside the outer diameter 101 of the rotor 100 and into the vane cells 140. The constituents, such as gases and suspended matter (e.g., lubricants), from the rotor 100 face environment may slightly contaminate the pumped gas or engine fuel-air mixture in the vane cell 140 and degrade the performance of the rotary vane pumping machine by a small amount. In addition, this location of the outer terminal position 127 also minimizes introducing vane cell 140 gases into the environment of the rotor 100 axial face.

However, regardless of this slight contamination, it is preferable that the outer terminal position 127 be chosen so that the upper end of the vane gear racks 129 does indeed extend outside the outer diameter 101 of the rotor 100 as the vane 120 reciprocates. The reason is to provide for extended roller travel, whereby the aligned rollers 132 come as close to the outer diameter 101 of the rotor as possible when the vane 120 reciprocates to reduce the lever effect of the vane 120 within the vane slot 130. The overall advantage provided by the extended roller travel offsets the negligible contamination of the vane cell 140 and rotor 100 axial face environments.

The spaces S (see FIG. 4B) between the recesses of the vane gear rack 129 are small compared to the radial thickness of rotor slot seal lips 103 (see FIG. 4A), which seal the vane cells 140 from the vane slot 130. Thus the recesses of the vane gear rack 129 do not establish, at any time during the reciprocating movement of the vane 120, flow communication between the vane cells 140 and the space enveloping the rotor 100 axial face and slots 130. Thus the sometimes large pressure differences between the vane cells 140 and this space enveloping the rotor 100 axial face and slots 130 is not able to cause a substantial exchange of gases. The only gas exchange is a minimal amount conveyed by a few recesses of the vane gear rack 129 which may be exposed to the vane cells 140 during the greatest radial extension of the vane 120. Because the total volume of gas contained in such exposed recesses of the vane gear racks 129 is relatively insignificant, the invention still operates efficiently if the outer terminal position 127 is moved outside the outer diameter 101 of the rotor 100 and closer to the vane tip 122.

Figure 4B:
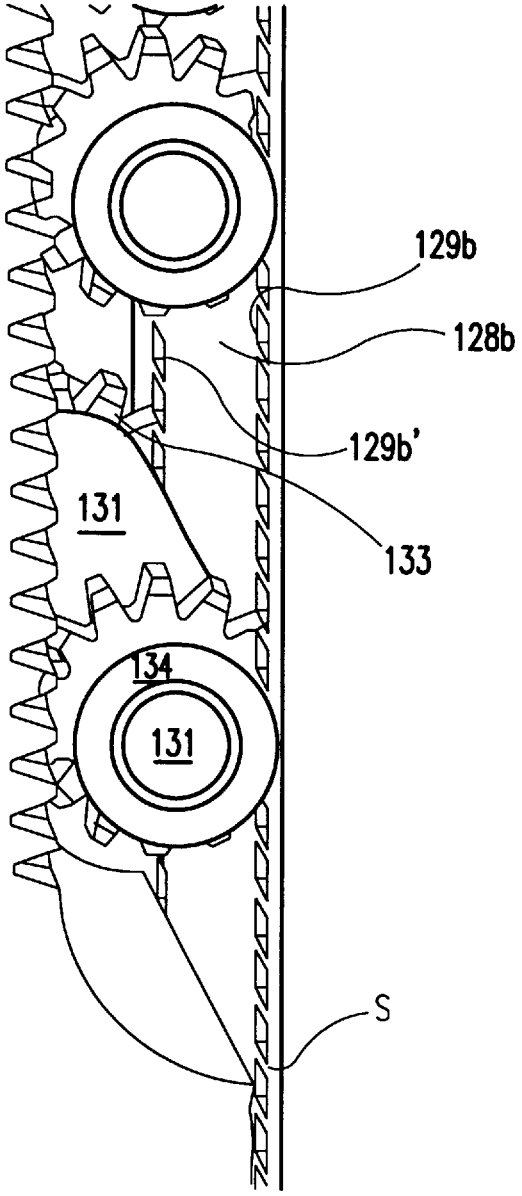
FIG. 4B is an enlarged view of the roller gears and vane gear racks from section B of FIG. 4A.

In the preferred embodiment, the aligned rollers 132 each have a second roller gear 133, and the two roller gears 133 are disposed on opposite ends of the aligned roller 132 as shown in FIG. 4B. This arrangement helps balance the two axial ends of the roller 132 to move in unison. This second roller gear 133 on each aligned roller 132 is called a balancing roller gear 133. To engage the balancing roller gear 133, another gear rack 129, i.e., a balancing vane gear rack 129*b*', is needed on each vane side wall 128, e.g., 128*b*, with such aligned rollers 132. Similarly, another slot gear rack 136, i.e., a balancing slot gear rack 136, e.g., 136*a*' (see FIG. 4A), is needed on each slot side wall 138, e.g., 138*a*, with such aligned rollers 132 with two roller gears 133. In the preferred embodiment, at least one aligned roller 132 with the two roller gears 133 is disposed on each side of the vane 120 to engage the respective slot gear racks and vane gear racks.

Each aligned roller 132 has a cylindrical bearing 131 that transfers the azimuthal momentum between vane 120 and rotor 100, and rolls to reduce friction and wear from the radial movement of the vane 120. The bearing 131 and the gear 133 can move in unison if the pitch diameter ($D_P$) of the gear is substantially equal to the diameter ($D_B$) of the cylindrical bearing. In this case, the gear 133 can be formed to be integral with the bearing 131, which is the preferred embodiment of the aligned roller 132. This relationship is described in more detail with reference to FIG. 4C.

A circular gear has two obvious physical diameters, an outer diameter $D_O$ that measures the distance between the outermost parts of two teeth on opposite sides of the gear, and a root diameter $D_R$ that measures the distance between the roots of two teeth on opposite sides of the gears. As known to those of ordinary skill in the art of gear design, the pitch diameter $D_P$ is the diameter of an imaginary circle that rolls without slippage on a line of action of the mating rack as the gear teeth interact with the rack teeth. In general, $D_R$ is less than $D_P$ which is less than $D_O$. The distance between the top of a rack tooth and the rack line of action is the addendum distance $D_A$, and the distance between the root of a rack tooth and the rack line of action is the dedendum distance $D_D$. The teeth of the gear also have an addendum distance (i.e., the radial distance between the pitch circle and the top of the tooth), and a dedendum distance (i.e., the radial distance between the pitch circle and the bottom of the tooth space).

Figure 4D:
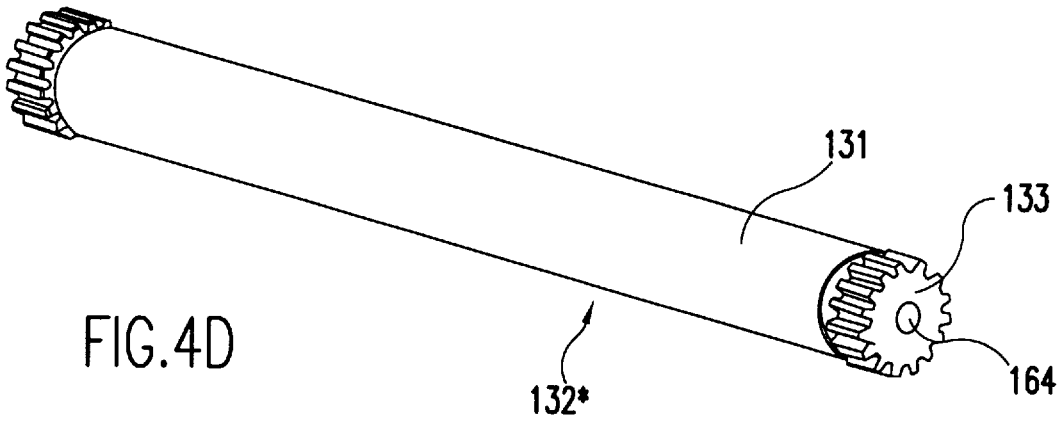
FIG. 4D is a perspective view of an integral roller according to a preferred embodiment of the invention.
Figure 4C:
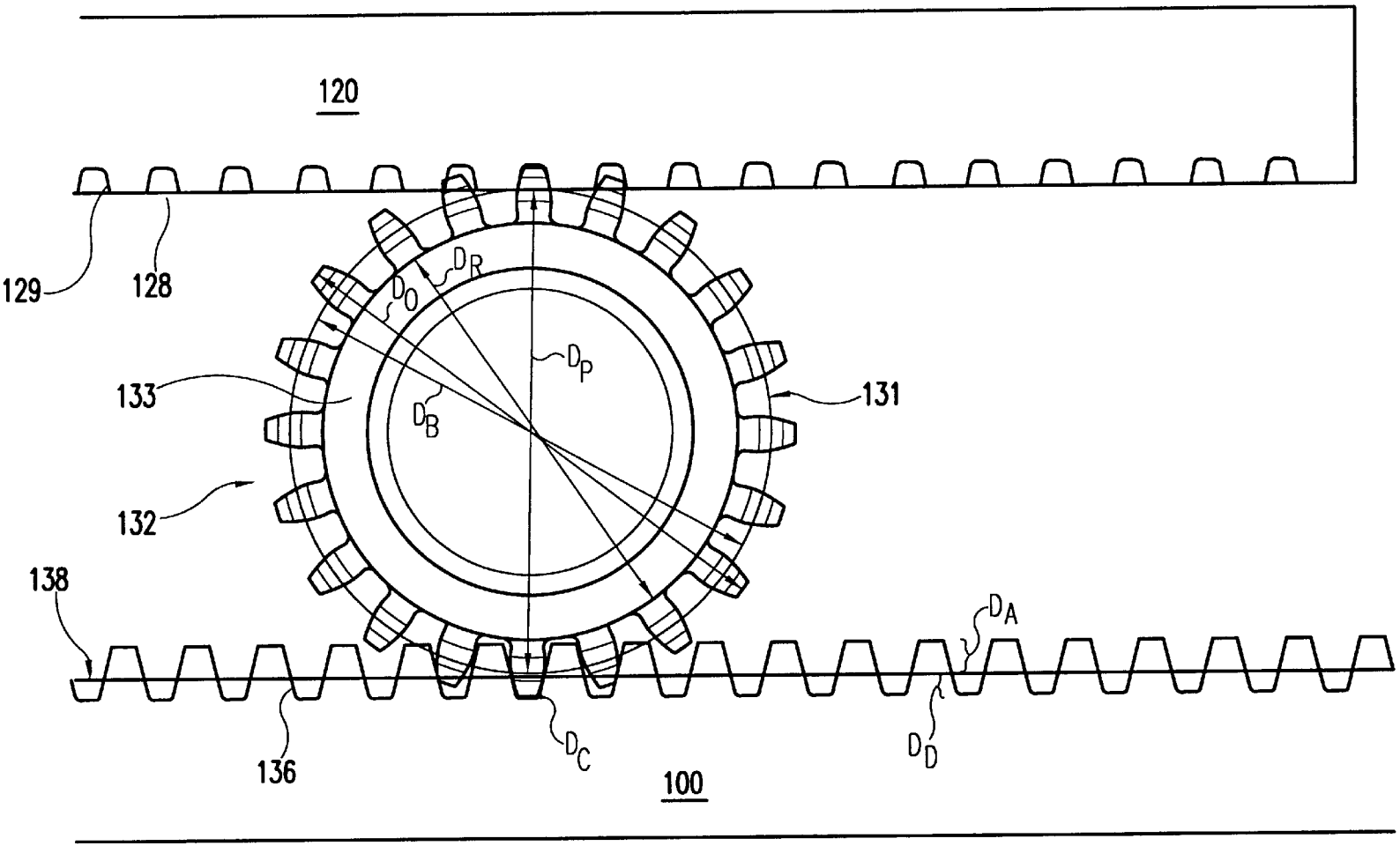
FIG. 4C is cross section of a roller, roller gear, vane rack, and rotor rack according to another embodiment of the invention.

According to the preferred embodiment of the present invention as shown in FIG. 4C, the bearing diameter $D_B$ is chosen to equal the pitch diameter $D_P$, the line of action of the rotor rack 136 is at the slot wall 138, and the line of action of the vane rack 129 is the vane wall 128. In this case, the bearing 131 will roll without slippage with respect to the gear 133, as it rolls between the slot wall 138 and the vane wall 128. In this preferred embodiment, therefore, an integral aligned roller 132* is made of a bearing 131 integrated with a gear 133 as shown in FIG. 4D.

Furthermore, in the preferred embodiment as shown in FIG. 4C, the addendum distance $D_A$ for the vane rack 129 is set to substantially zero. This permits effective sealing against the rotor slot lip 103 (FIG. 4A) without having to cut a recess in the rotor slot seal lip 103 to accommodate the protruding teeth of the vane gear rack 129. This has the added advantage of allowing the vane wall 128 to be lapped flat which facilitates the manufacture of the vanes 120. To maintain suitable contact between the gear 133 and the vane rack 129 with the addendum missing, the effective gear contact ratio, as determined by the number of teeth and pressure angle, should be no less than about 1.0. Contact ratio expresses the average number of pairs of teeth in contact at all times during the interaction of gear and rack. Note that the rotor rack 136 can have both addendum and dedendum to aid in engagement with the roller gear.

If the pitch diameter $D_P$ is not substantially equal to the bearing diameter $D_B$, the gear 133 and bearing 131 will roll at different angular velocities in order to have the same translational velocity. Therefore an alternative embodiment for the aligned roller 132 is contemplated, as shown in FIG. 4B. In the alternative embodiment, the roller gear 133 is fixedly attached to a sleeve 134. The sleeve 134 is rotatably connected to the bearing 131 so that the sleeve 134 can rotate at a different angular velocity than the bearing 131 while translating at the same linear velocity. Many variations of such a connection are well known to those of ordinary skill in the art; for example, the bearing 131 or a central axle of the bearing 131 can extend through the center of the sleeve 134. In this alternative, the aligned roller 132 is composed of a roller gear 133 that is not integral with the roller bearing 131.

In one embodiment of this invention, an axial filler slot 139 is disposed on the side wall 138 of the vane slot 130, as shown in FIG. 4A. The purpose of the axial filler slot 139 is to facilitate the installation of the aligned rollers 132 between the vane 120 and vane slot 130. A filler slot recess 139' accommodates the roller gears 133 of the aligned roller 132 when placed in the axial filler slot 139. The axial filler slot 139 is located near the outer diameter 101 of the rotor 100 so that aligned rollers 132 can be introduced and engaged with the vane gear rack 129 as the vane 120 is inserted into the vane slot 130.

The axial filler slot 139 is far enough from the outer diameter 101 of the rotor 100 so that the outer surface of the rotor 100 has sufficient strength to withstand the fluid mechanical, mechanical and thermal stresses encountered within the vane cells 140 during the machine cycles. The axial filler slot 139 is at least large enough to accommodate an aligned roller 132 positioned adjacent to the vane 120 before the teeth of its roller gear 133 are engaged with the vane gear rack 129. In one embodiment, the axial filler slot 139 is shaped to fit an aligned roller 132 when displaced azimuthally away from the vane 120 by an amount equal to half the difference between the maximum gear diameter $D_O$ and the bearing diameter $D_B$. If the aligned roller 132 employs the integral embodiment, the axial filler slot 139 must be large enough to pass the roller gear 133 axially through the rotor 100. If the aligned roller 132 employs the separate bearing 131 and sleeve 134 embodiment, the axial filler slot 139 need only pass the bearing 131 axially through the rotor. In this case, the sleeves 134 with the gears 133 can be installed on the bearing 131 from either axial side of the rotor 100 after the bearing 131 has been inserted through the axial filler slot 139. Using the axial filler slot 139, the aligned roller is first inserted through the rotor 100 and then moved toward the vane 120 so that teeth of the roller gear 133 engage the vane gear rack 129 at an entry point.

The aligned roller 132 rolls inward toward the rotor 100 axis as the vane 120 is inserted, at half the velocity of the vane 120. Since the aligned roller 132 only rolls at half the rate, the innermost aligned roller 132 can be positioned no farther from the axial filler slot 139 than half the distance from the axial filler slot 139 to the entry point on the vane gear rack 129. The innermost position for an aligned roller 132 occurs when the vane 120 is fully inserted, as in FIG. 4A. To reach the innermost possible position, the vane gear rack 129 is extended to the base end of the vane 120 in the preferred embodiment, to enable an entry point at the base of the vane 120.

Figure 4E:
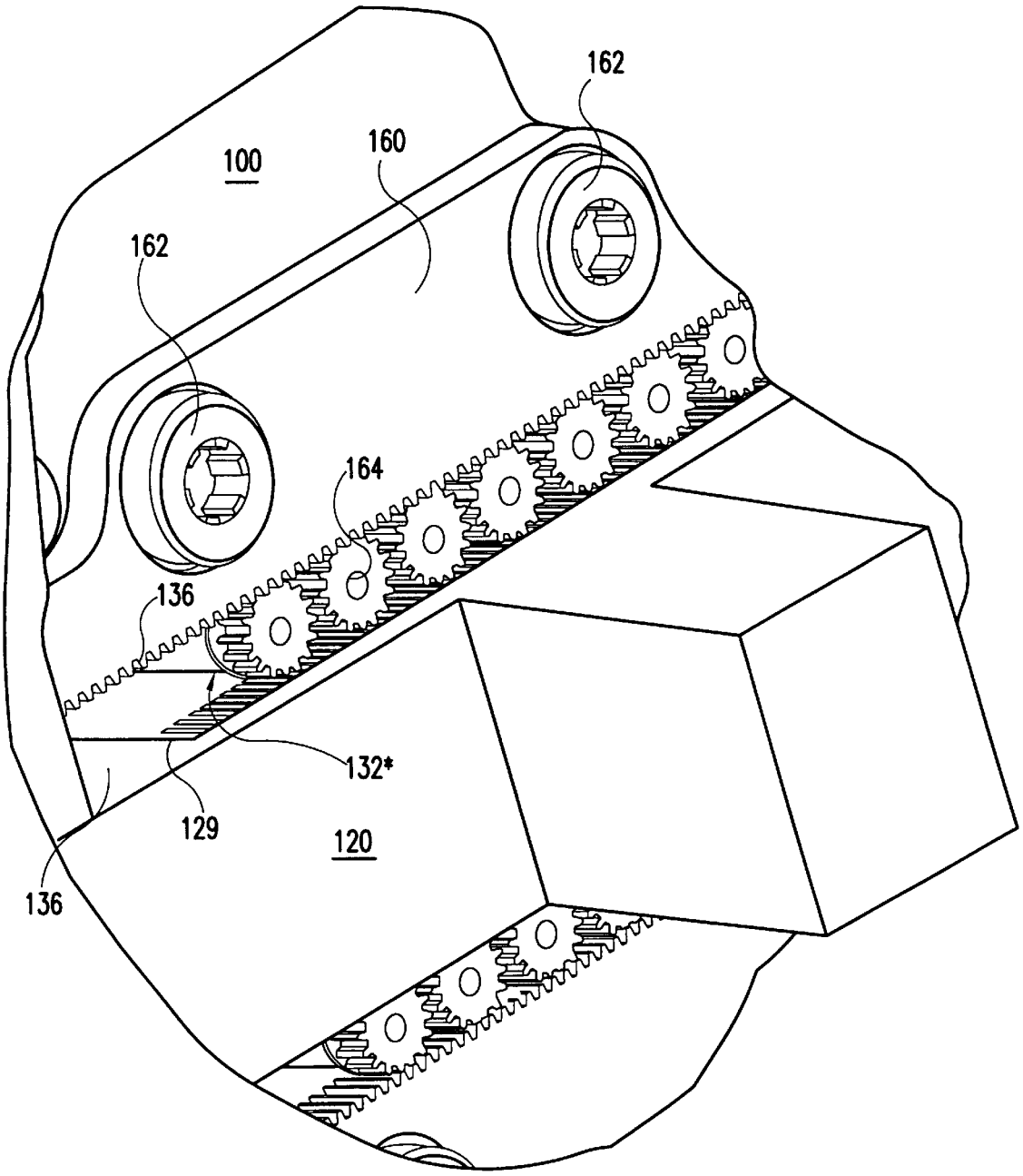
FIG. 4E is a perspective view of one portion of the rotor showing a slot gear rack plate fixed to an axial face of the rotor according to another embodiment of the present invention.

In the preferred embodiment an axial filler slot 139 is not needed. Instead, as shown in FIG. 4E, the slot gear rack 136 is formed along one edge of a slot gear rack plate 160 that is fixed to the axial face of the rotor 100 by a fixing means 162, such as a screw or bolt, so that the slot gear rack 136 is oriented along the slot side wall in a position to engage the gears 133 of the aligned rollers 132*. To aid in positioning the aligned rollers during installation of this embodiment, the aligned rollers 132* have a hole 164 disposed in at least one axial end where an aligning pin or tool can be inserted.

In the preferred embodiment, with the separate slot gear rack plate 160, the vane slot roller assembly can be installed very easily. As an example of the installation method, the vane 120 having a vane gear rack 129 is first positioned in a vane slot 130 of a rotor 100. A pin or tool is inserted into a hole 164 disposed in an axial end of each integral aligned roller 132* to be included in the assembly. The pins are arranged in a predetermined pattern and aligned relative to the vane slot 130. The aligned rollers 132* are then engaged with the vane gear rack 129. Then, the slot gear rack plate 160 is placed against an axial face of the rotor 100 so the slot gear rack 136 is disposed radially along a slot side wall 138 and engages the aligned rollers 132*. Next, the slot gear rack plate 160 is fixed to the axial face of the rotor 100 using the fixing means 162. Finally, the pins are removed from the holes 164 disposed in the axial ends of the aligned rollers 132, leaving the rollers engaged with both vane and slot gear racks 129, 138, respectively, and in the proper relative locations.

The aligned rollers 132 do not necessarily provide axial centering for the vane 120 during operation of the rotary vane pumping machine 10. For example, if the vane and slot gear racks 129, 136 are extended axially, or if the slot gear rack 136 is disposed at the axial face as shown in FIG. 4A and the aligned rollers 132 employ a separate sleeve 134, the vane 120 can still drift axially and encounter friction and wear with the axial faces of the axially adjacent assembly such as the linear translation ring assembly plate 300. To prevent such axial drifting, another aspect of the vane slot roller assembly includes an axial centering roller 162, as shown in FIGS. 5A and 5B.

Figure 5A:
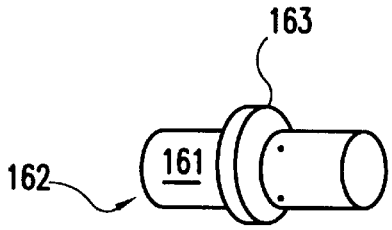
FIG. 5A is a perspective view of an axial centering roller according to another embodiment of the present invention.
Figure 5B:
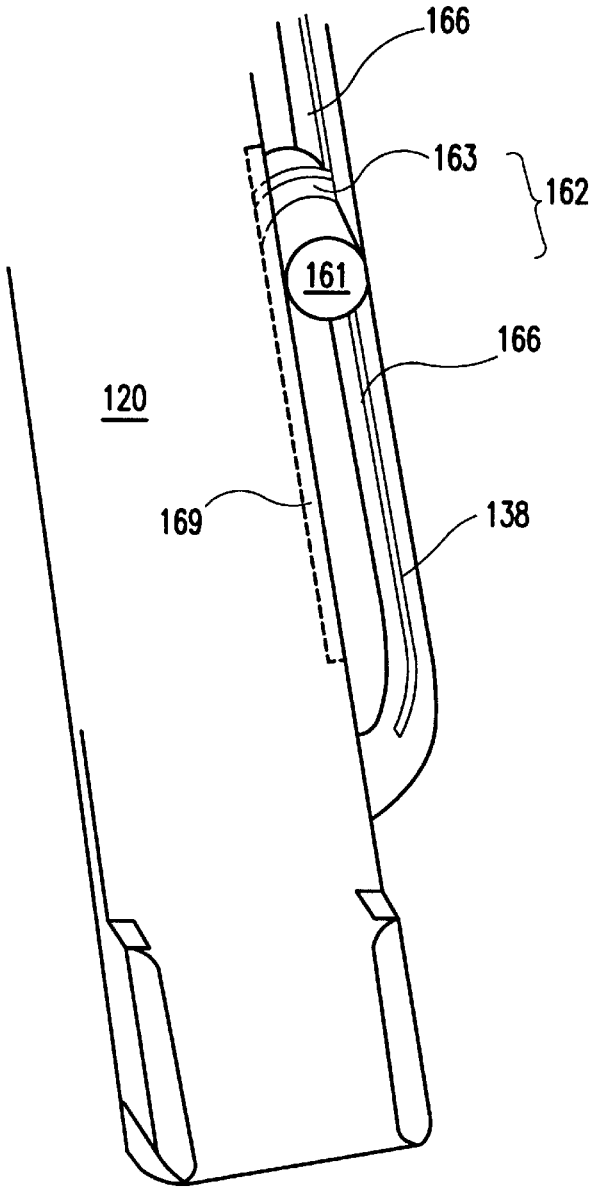
FIG. 5B is a perspective view of the vane, roller and slot according to the embodiment of the present invention employing an axial centering roller.

Referring to FIG. 5A, an axial centering roller 162 includes a cylindrical bearing 161 with a bearing diameter and an extension sleeve 163 with an extension sleeve diameter. The extension sleeve 163 engages a vane groove 169 disposed in at least one vane side wall 128 of a vane 120, as shown in FIG. 3 and FIG. 5B. Referring to FIG. 5B, the extension sleeve 163 also engages a slot groove 166 disposed in at least the facing slot side wall 138. With this configuration, axial drifting by the vane 120 is prevented and axial centering of the vane 120 is provided because the extension sleeve 163 transfers an opposing force provided by an axial face of the slot groove 166 to the opposite axial face of the vane groove 169. The outer radial extent of the vane groove 169 is chosen such that the vane groove 169 would not extend outside the outer diameter 101 of the rotor as the vane 120 reciprocates, thereby minimizing the exchange of contaminating constituents between the airborne environment enveloping the rotor 100 axial face and positions outside the outer diameter 101 of the rotor 100 and into the vane cells 140.

The cross sectional shape of the extension sleeve 163 should have axial faces that match closely the axial faces of the vane groove 169 and the slot groove 166. Any cross sectional shape available to those of ordinary skill in the art is appropriate for the extension sleeve as long as the axial faces match those of the vane groove 169 and the slot groove 166. For example, the extension sleeve 163 can have a rectangular cross section, a triangular cross section, an arcuate cross section, or a trapezoidal cross section if the vane and slot grooves 169 and 166 have corresponding shapes.

In the preferred embodiment, axial centering rollers 162, vane grooves 169, and slot grooves 166 are disposed on both side walls of the vane 120 and vane slot 130. Also in the preferred embodiment, the axial centering roller is the innermost roller, i.e., the roller disposed closest to the axis of the rotor 100.

It will be apparent to those skilled in the art that various modifications and variations can be made in the system and method of the present invention without departing from the spirit or scope of the invention. For example, the number and mix and relative positions of aligned, axial centering and conventional rollers, or the number of roller gears per aligned roller, or the shape and number of teeth per gear, or the magnitudes of $D_O$, $D_R$, and $D_B$, can all be readily modified by one of ordinary skill. Thus, it is intended that the present invention cover the modifications and variations of this invention provided they come within the scope of the appended claims and their equivalents.

What is claimed is:

1. A vane slot assembly for a rotary vane pumping machine comprising:

a rotor with a rotor axis of rotation, having a vane slot with two opposing azimuthally separated slot side walls and including a primary slot gear rack disposed radially along a first slot side wall;

a radially reciprocating vane movably disposed between the slot side walls, having vane side walls confronting the slot side walls and having a primary vane gear rack disposed radially along a first vane side wall confronting the first slot side wall; and a plurality of vane slot rollers movably disposed between the first slot side wall and the first vane side wall, having axes of rotation substantially parallel to the rotor axis, and including an aligned roller having a primary roller gear, wherein the primary roller gear engages the primary vane gear rack and the primary slot gear rack.

2. The vane slot assembly of claim 1, wherein the aligned roller is an outermost roller.

3. The vane slot assembly of claim 1, the plurality of vane slot rollers further comprising another aligned roller having a primary roller gear.

4. The vane slot assembly of claim 1, the aligned roller further comprising:

a cylindrical bearing having a bearing diameter different from a gear pitch diameter of the primary roller gear; and a primary sleeve fixed to the primary roller gear and rotatably connected to the bearing, whereby the roller gear may roll at a different angular velocity than the bearing and translate at a same translation velocity.

5. The vane slot assembly of claim 1, the aligned roller further comprising a cylindrical bearing integral with the primary roller gear, the bearing having a bearing diameter substantially equal to a gear pitch diameter of the primary roller gear, whereby the roller gear rolls at a same angular velocity as the bearing and translates at a same translational velocity.

6. The vane slot assembly of claim 1, further comprising:

a balancing slot gear rack disposed along the first slot side wall, spaced axially apart from the primary slot gear rack and oriented parallel to the primary slot gear rack; and a balancing vane gear rack disposed along the first vane side wall, spaced axially apart from the primary vane gear rack and oriented parallel to the primary vane gear rack, wherein the aligned roller further comprises a balancing roller gear, and wherein the balancing roller gear engages the balancing vane gear rack and the balancing slot gear rack.

7. The vane slot assembly of claim 1, further comprising:

an opposing slot gear rack disposed radially along a second slot side wall;

an opposing vane gear rack disposed radially along a second vane side wall;

a plurality of opposing vane slot rollers movably disposed between the second slot side wall and the second vane side wall, having axes of rotation substantially parallel to the rotor axis, and including an opposing aligned roller having an opposing roller gear, wherein the opposing roller gear engages the opposing vane gear rack and the opposing slot gear rack.

8. The vane slot assembly of claim 1, the rotor further comprising an axial filler slot disposed in a side wall of the vane slot, spaced apart from the outer diameter of the rotor, for installing the aligned roller.

9. A vane slot assembly for a rotary vane pumping machine comprising:

a rotor with a rotor axis of rotation, having a vane slot with two opposing azimuthally separated slot side walls;

a primary slot gear rack plate fixed to a first axial face of the rotor so that a primary slot gear rack formed on the plate is disposed radially along a first slot side wall;

a slot rack fixing means that fixes the primary slot gear rack plate to the first axial face of the rotor;

a radially reciprocating vane movably disposed between the slot side walls, having vane side walls confronting the slot side walls and having a primary vane gear rack disposed radially along a first vane side wall confronting the first slot side wall; and a plurality of vane slot rollers movably disposed between the first slot side wall and the first vane side wall, having axes of rotation substantially parallel to the rotor axis, and including an aligned roller having a primary roller gear, wherein the primary roller gear engages the primary vane gear rack and the primary slot gear rack.

10. The vane slot assembly of claim 9, wherein the primary vane gear rack extends to a base end of the first vane side wall, the base end being closest to the rotor axis.

11. The vane slot assembly of claim 9, the aligned roller further comprising:

a cylindrical bearing integral with the primary roller gear, the bearing having a bearing diameter substantially equal to a gear pitch diameter of the primary roller gear, whereby the roller gear rolls at a same angular velocity as the bearing and translates at a same translational velocity; and an installation hole disposed in an axial end of the aligned roller, for alignment of rollers with the primary vane gear rack before the primary slot gear rack plate is fixed to the first axial face of the rotor.

12. A vane slot assembly for a rotary vane pumping machine comprising:

a rotor with a rotor axis of rotation, having a vane slot with two opposing azimuthally separated slot side walls and including a slot groove disposed radially along a first slot side wall;

a radially reciprocating vane movably disposed between the slot side walls, having vane side walls confronting the slot side walls and having a vane groove disposed radially along a first vane side wall confronting the first slot side wall; and a plurality of vane slot rollers movably disposed between the first slot side wall and the first vane side wall, having axes of rotation substantially parallel to the rotor axis, and including an axial centering roller having an extension sleeve, wherein the extension sleeve engages the vane groove and the slot groove.

13. The vane slot assembly of claim 12, wherein the axial centering roller is an innermost roller.

14. The vane slot assembly of claim 12, wherein a cross sectional shape of the extension sleeve corresponds to a cross sectional shape of the vane groove.

15. The vane slot assembly of claim 12, wherein a radial length of the vane groove is sized such that an outer radial extent of the vane groove does not extend outwardly of the outer diameter of the rotor as the vane reciprocates.

16. A method of installing a vane slot assembly for a rotary vane pumping machine having a rotor with vane slots and vanes, comprising:

positioning a vane having a vane gear rack in a vane slot of a rotor;

engaging aligned rollers with the vane gear rack;

positioning the aligned rollers in the slot;

positioning a slot gear rack plate against an axial face of the rotor so a slot gear rack is disposed radially along a slot side wall and engages the aligned roller; and fixing the slot gear rack plate to the axial face of the rotor.

17. The method of claim 16, further comprising:

inserting a pin into a hole disposed in an axial end of an aligned roller, before said engaging;

aligning the pin with the aligned roller thereon relative to the vane slot, before said engaging; and removing the pin from the hole disposed in the axial end of the aligned roller, after said fixing.

18. A method of installing a vane slot assembly for a rotary vane pumping machine having a rotor with vane slots and vanes, the method comprising:

positioning an aligned roller in an axial filler slot in a vane slot of a rotor, the vane slot having a slot gear rack on a slot side wall contiguous with the axial filler slot;

inserting a vane with a vane gear rack on a vane side wall into the vane slot until an entry point on the vane gear rack is facing the axial filler slot;

engaging the aligned roller with the vane gear rack; and further inserting the vane into the slot, whereby the aligned roller rolls to a radially inward location engaged with both the vane gear rack and the slot gear rack.

* * * * *